US011719513B2

(12) United States Patent
Morrison

(10) Patent No.: US 11,719,513 B2
(45) Date of Patent: Aug. 8, 2023

(54) ADJUSTABLE FIREARM ACCESSORY

(71) Applicant: Sig Sauer, Inc., Newington, NH (US)

(72) Inventor: Michael K. Morrison, Tualatin, OR (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 17/152,617

(22) Filed: Jan. 19, 2021

(65) Prior Publication Data

US 2021/0223003 A1 Jul. 22, 2021

Related U.S. Application Data

(60) Provisional application No. 62/962,441, filed on Jan. 17, 2020.

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 2,151,768 A * 3/1939 Humeston ..... F41G 11/003 42/124
2,441,968 A * 5/1948 Henry ..... F41G 1/24 42/137
2,576,007 A * 11/1951 Fischer ..... F41G 11/001 42/126
2,717,447 A * 9/1955 Leupold ..... F41G 11/001 42/127
2,857,675 A * 10/1958 Kesselring ..... F41G 11/001 42/127
3,133,353 A * 5/1964 Williams ..... F41G 1/42 42/141
3,785,603 A * 1/1974 Apel ..... F41G 11/001 248/222.13
3,867,764 A * 2/1975 Dunmire ..... F41G 1/35 42/115
4,742,636 A * 5/1988 Swan ..... F41G 11/006 42/126
4,756,111 A * 7/1988 Lapier ..... F41G 11/004 42/128
4,860,480 A * 8/1989 Ruger ..... F41G 11/001 42/124
5,033,219 A * 7/1991 Johnson ..... F41G 11/003 42/115
5,490,654 A * 2/1996 Herriman ..... F41G 11/001 248/309.1
5,680,725 A * 10/1997 Bell ..... F41G 11/003 42/127

(Continued)

*Primary Examiner* — Michelle Clement
(74) *Attorney, Agent, or Firm* — Miller Nash LLP

(57) ABSTRACT

An accessory mounting system for adjustably mounting an accessory to a firearm accessory rail having a series of slots includes a rail clamping system structured to clamp to the firearm accessory rail, a mounting member having a tab structured to engage with one of the series of slots of the firearm accessory rail; and an adjustment mechanism that allows the accessory to be moved along a long axis of the firearm accessory rail less than a slot pitch of the firearm accessory rail.

8 Claims, 13 Drawing Sheets

(56) References Cited

U.S. PATENT DOCUMENTS

D594,318 S * 6/2009 Fell ..... D22/110
8,171,666 B2 * 5/2012 Karagias ..... F41G 11/003 42/124
9,417,034 B1 * 8/2016 Swan ..... F41G 1/17
9,618,302 B2 * 4/2017 Kintzing ..... F41G 1/38
10,048,040 B1 * 8/2018 Ratliff ..... F41G 11/003
10,240,901 B1 * 3/2019 Cheng ..... F41A 35/00
10,352,658 B1 * 7/2019 Aslin ..... F41G 11/001
10,634,456 B1 * 4/2020 Fischer ..... F41G 11/003
2002/0162267 A1 * 11/2002 Nelson ..... F41G 1/35 42/120
2009/0044439 A1 * 2/2009 Phillips ..... F41C 23/14 42/72
2010/0005697 A1 * 1/2010 Fluhr ..... F41G 1/033 42/111
2010/0058640 A1 * 3/2010 Moore ..... F41G 1/35 42/114
2011/0154713 A1 * 6/2011 Jung ..... F41G 1/473 42/137
2011/0296731 A1 * 12/2011 Carlson ..... F41G 11/001 42/90
2013/0104441 A1 * 5/2013 Kincel ..... F41G 11/004 42/90
2014/0093314 A1 * 4/2014 Kessler ..... F16M 13/00 403/361
2014/0252187 A1 * 9/2014 Petrovic ..... F16B 2/185 248/229.16
2014/0305022 A1 * 10/2014 Chung ..... F41G 1/32 42/113
2015/0041538 A1 * 2/2015 Teetzel ..... F41G 11/003 235/404
2016/0238346 A1 * 8/2016 DiCarlo ..... F41G 11/003
2016/0377385 A1 * 12/2016 Culp ..... F41G 11/003 42/126
2017/0067720 A1 * 3/2017 Visinski ..... F41G 11/003
2017/0102213 A1 * 4/2017 Bartoszewicz ..... F41G 11/003
2017/0248389 A1 * 8/2017 DiCarlo ..... F41G 11/007
2018/0073839 A1 * 3/2018 Crispin ..... F41G 1/48
2019/0219365 A1 * 7/2019 Ma ..... F41G 11/003
2020/0271422 A1 * 8/2020 Ramirez ..... F41C 27/00
2020/0272044 A1 * 8/2020 Walker ..... F41G 11/00
2021/0223003 A1 * 7/2021 Morrison ..... F41G 11/003
2021/0389101 A1 * 12/2021 Hughes ..... F41G 11/003

* cited by examiner

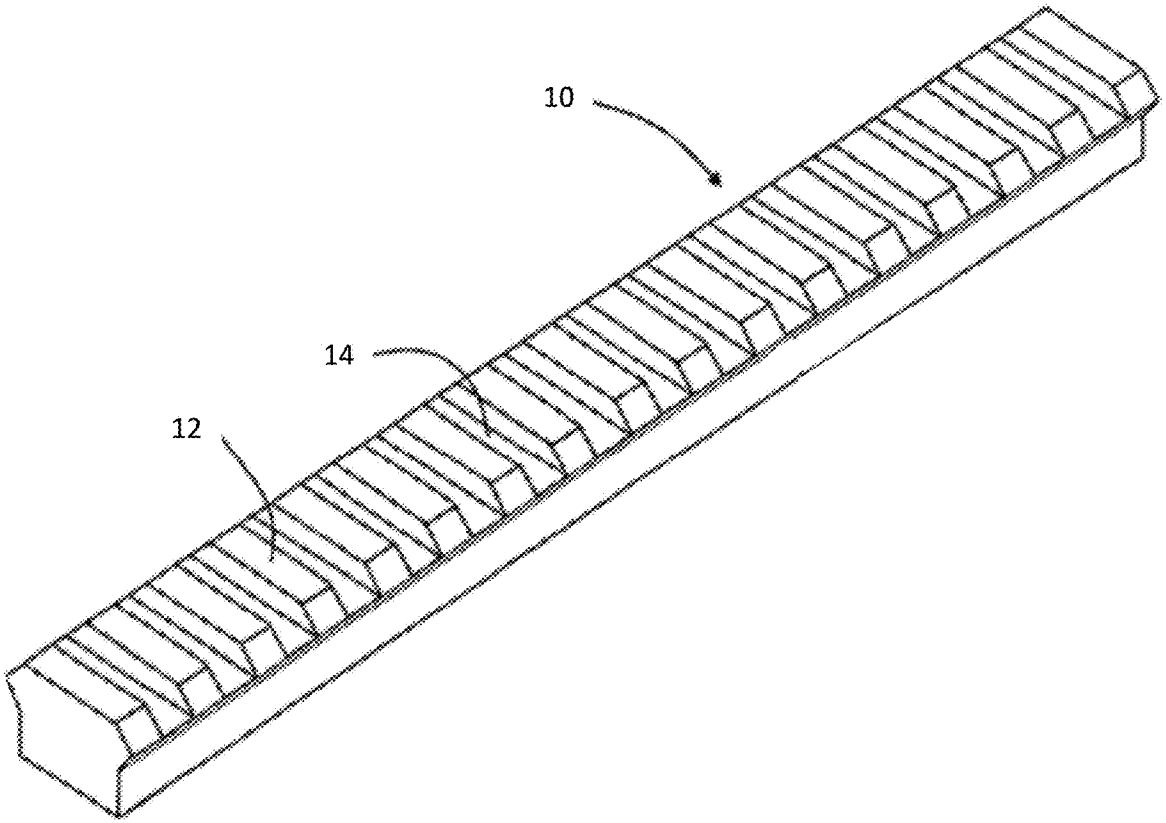
FIG. 1 (Conventional)

ADJUSTABLE FIREARM ACCESSORY

CROSS-REFERENCE TO RELATED APPLICATIONS

This application is a non-provisional of and claims benefit from U.S. provisional patent application No. 62/962,441, titled ADJUSTABLE FIREARM ACCESSORY, filed Jan. 17, 2020, the disclosure of which is incorporated herein by reference in its entirety.

FIELD

This disclosure relates to an accessory for a firearm, and, more particularly, to an accessory that allows a user of firearm to easily adjust a position of the accessory.

BACKGROUND

Many firearms, such as pistols, rifles etc., include one or more mounting brackets known as rails. There are many different types of rails. In general, accessories to those firearms physically mount to its rail using bolts, multiple adjustor plates, cammed levers, friction holds, and other mounting mechanisms. Firearms produce recoil or kickback when fired, which is a sudden backward movement in reaction to a projectile being fired. Recoil occurs over a very short duration, measured in milliseconds, and may involve significant force, depending on the size of cartridge being fired. Since firearms exhibit significant and repeated recoil, firearm accessories must be securely mounted to the rail, otherwise they would quickly become loose or separate from the rail completely.

Some shooters like to be able to adjust accessories within the standard pitch of an accessory rail. For example, some accessory mounting rails have slots spaced approximately 10 mm apart, but the shooter may want to adjust the accessory less than 10 mm. In such a case, an accessory must have an ability to adjust within the rail pitch. Because of the strong recoil that firearms experience, accessories must be securely mounted to the rail. To allow adjustability, some manufacturers provide several different adjusting plates with an accessory so that the accessory may be adjusted within the slot pitch of the rail, with each adjusting plate positioning the accessory in a different position relative to same rail slot. The user selects the adjustment plate that causes the best or most comfortable accessory location, then screws down the selected plate, and then mounts the accessory to the rail. Such a system suffers from the problems of requiring multiple plates to be provided with the accessory, as well as requiring tools to adjust the accessory position on the rail, as well as other limitations, all of which are disadvantageous.

Embodiments of the invention address these and other issues in the art.

BRIEF DESCRIPTION OF THE DRAWINGS

FIG. 1 is a perspective view of a conventional Picatinny Rail.

DETAILED DESCRIPTION

Figure 2:
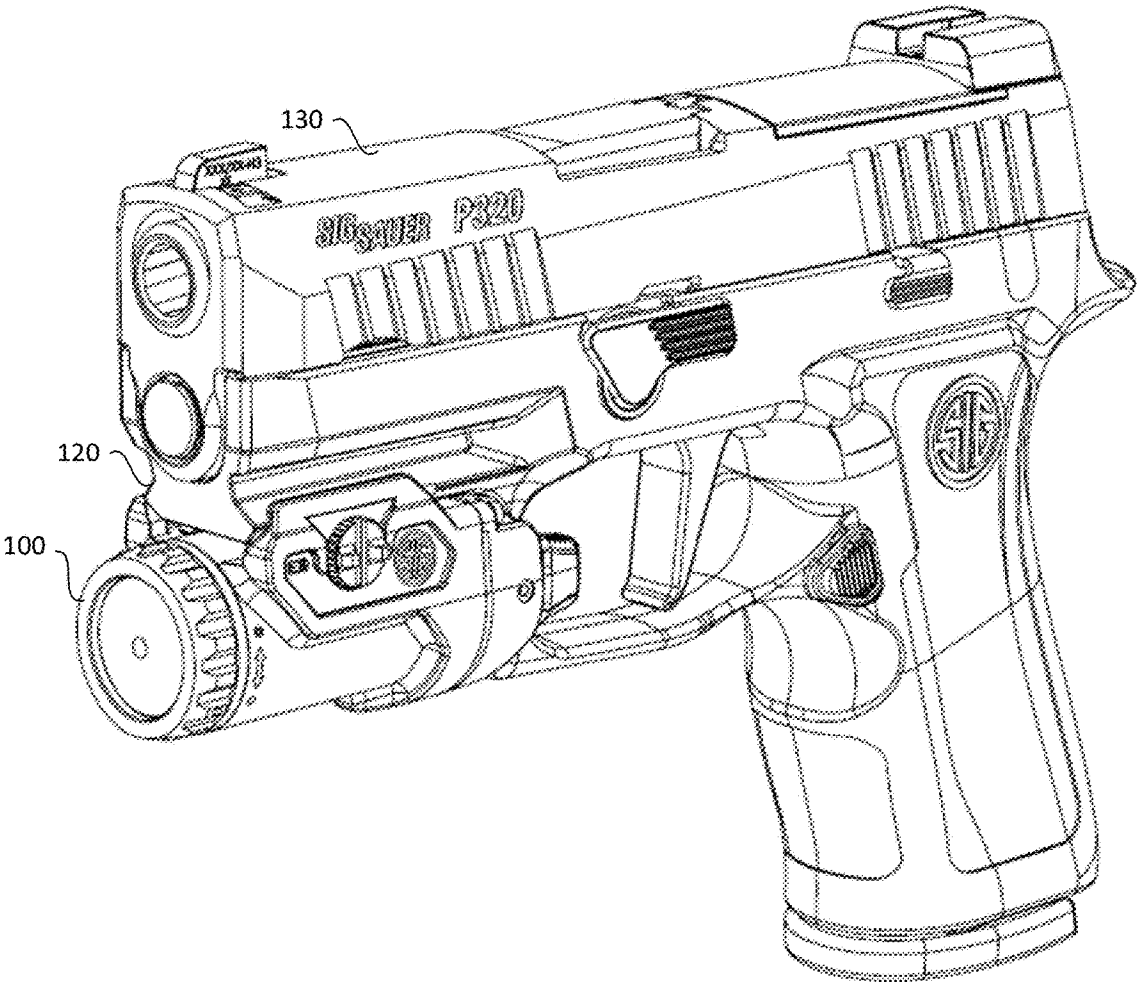
FIG. 2 is a perspective view of an accessory according to embodiments of the invention mounted on a rail of a pistol.

Embodiments disclosed herein include a firearm accessory that includes an ability to adjust a position relative to the firearm without the need for tools or a need for multiple adjuster plates. Although described here with reference to an accessory light, or flashlight, embodiments of the invention are applicable to any type of accessory, such as tactical lights, aiming modules, sights, scope mounts, night vision devices, and foregrips, among others.

As mentioned above, firearm accessory mounting rails are commonly attached to firearms. Well known examples of rails include the Picatinny rail, which was developed for the US Military as a uniform mounting system that could be attached to a firearm. Various accessories include a rail mount interface to allow them to be attached to the rail, and therefore also be firmly attached to the firearm. Typical rails include grooves, lugs, or locking slots that run horizontally along the length of a rail at a specified pitch.

FIG. 1 is a perspective view of a conventional Picatinny Rail 10. The Picatinny rail 10 includes a series of generally rectangular-shaped ridges 12 that are formed perpendicular to the long axis of the rail. The ridges 12 are separated by respective slots 14. In the common MIL-STD-1913 configuration of the Picatinny rail 10, the ridges 12 have a height of approximately 3 mm, and a spacing between adjacent ridges or slots 14 of approximately 10 mm. In general, an accessory is mounted at or within a slot 14. Because the slots 14 have set and even spacing, it is relatively easy to move an accessory relative to the firearm in one-slot increments by mounting the accessory in a different slot. For example, if the user of a firearm having a Picatinny rail 10 wishes to move a light toward the shooting end of the barrel 30 mm, the user first detaches the light from its current position and reattaches the light three slots 14 further along the barrel.

As mentioned above, sometimes users wish to adjust an accessory less than a standard slot pitch distance of a rail. FIG. 2 illustrates an accessory, in this case a flashlight, or light 100, mounted to a rail 120 of a pistol 130. The rail 120 in FIG. 1 is a Picatinny rail, but, as stated above, embodiments of the invention work with any type of rail. Note that the rail 120 of FIG. 2 is mounted in another position, i.e., upside-down from the orientation of the rail illustrated in FIG. 1.

Figure 3:
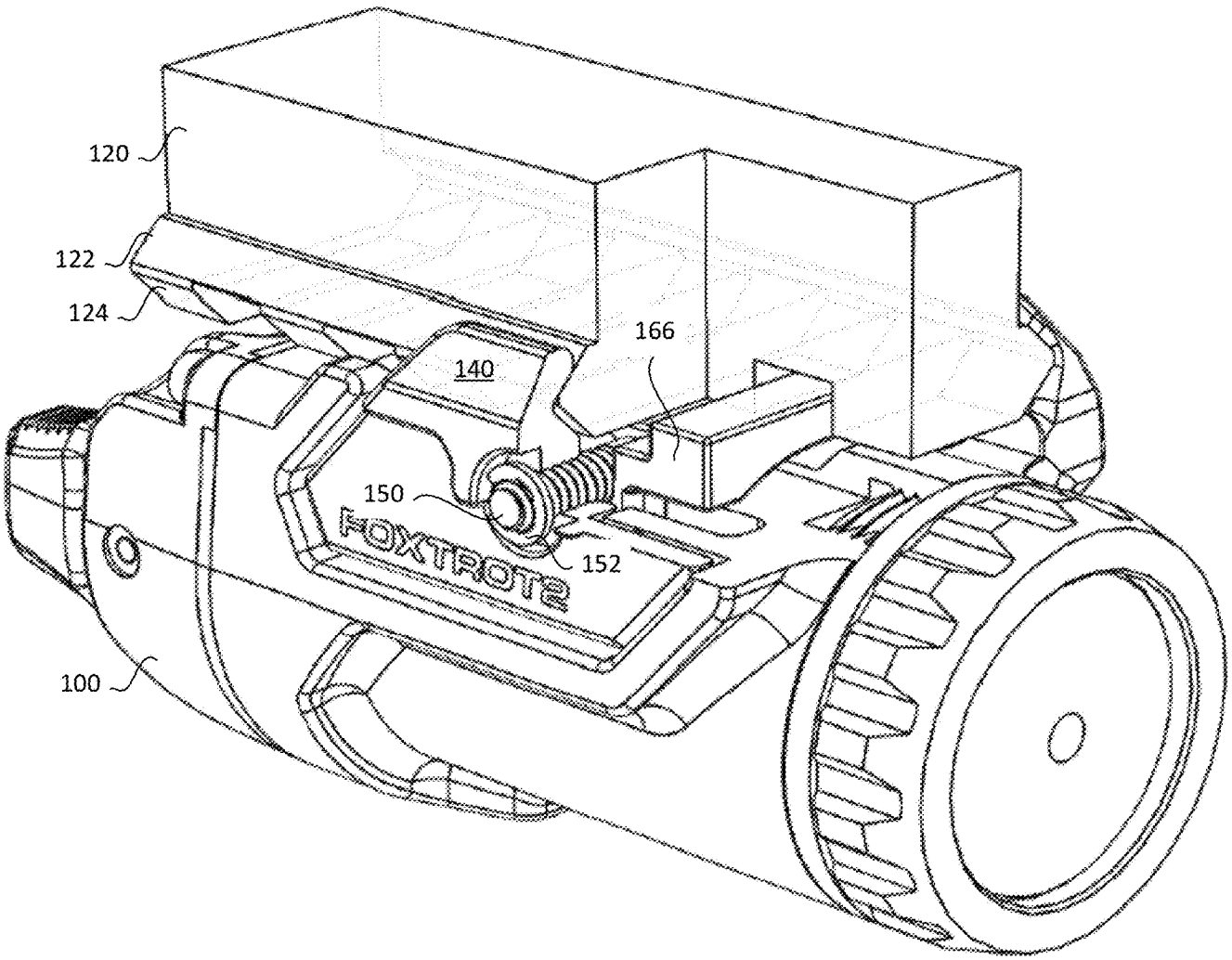
FIG. 3 is a partial cutaway view illustrating the accessory of FIG. 2 mounted on the rail, according to embodiments of the invention.

FIG. 3 is a partial cutaway view illustrating the accessory light 100 of FIG. 2 mounted to, also referred to as mounted on, the rail 120. The light 100 is attached to the rail 120 in such a way that it may be easily adjusted relative to the rail by less than a distance between slots 14 of the rail 120. In some embodiments the light 100 may be adjusted by indexed amounts. In some embodiments the adjustment may be made manually, i.e., without the use of tools.

With reference to FIG. 3, a keeper portion 140 is held to the body of the light 100 by a cross-slot bolt 150. A retaining ring 152 prevents the keeper portion 140 from completely separating from the light 100 when the cross-slot bolt 150 is fully loosened.

Figure 4:
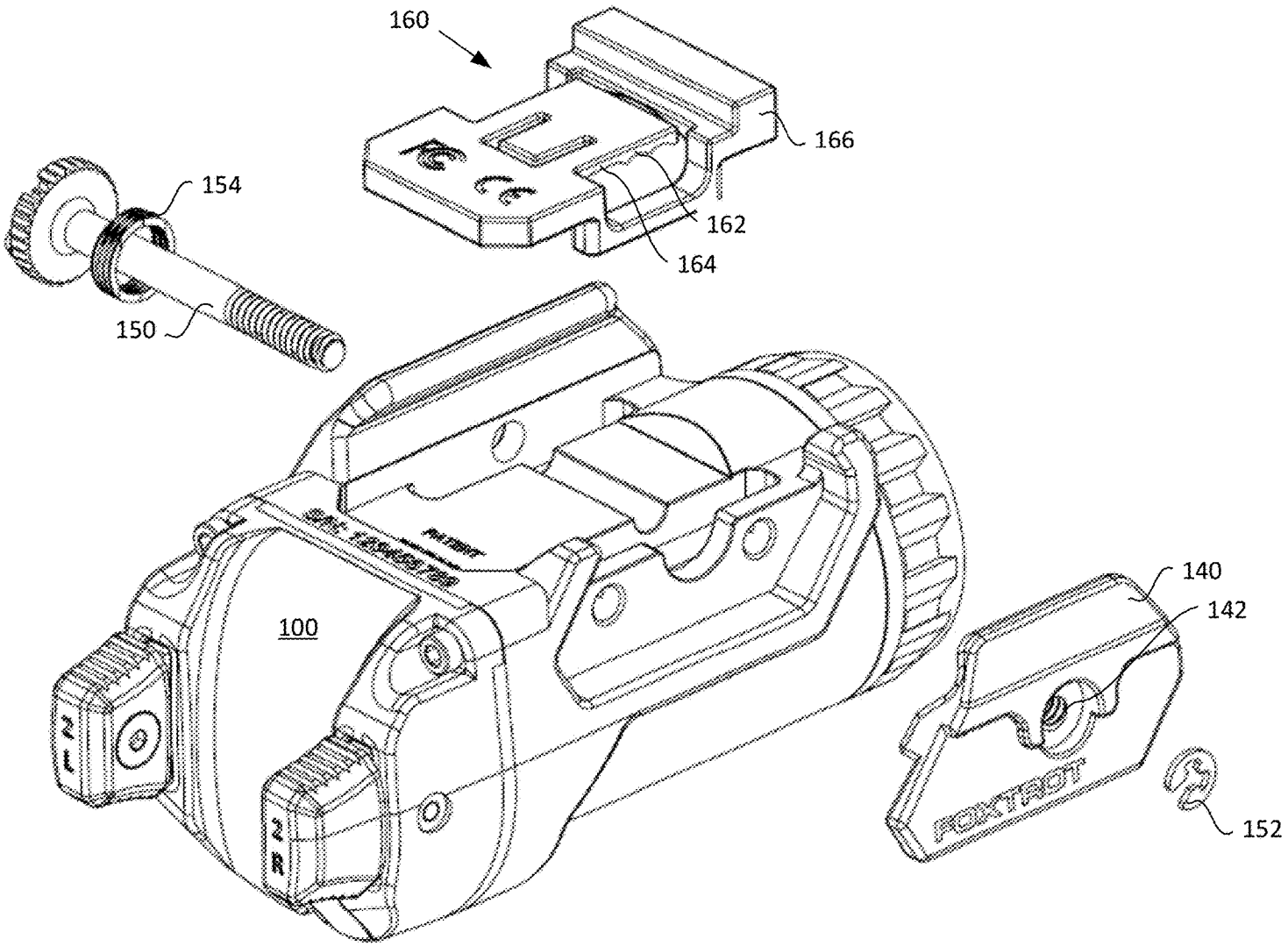
FIG. 4 is an exploded diagram illustrating additional components of the accessory according to embodiments of the invention.

FIG. 4 is an exploded diagram illustrating additional components of the accessory according to embodiments of the invention. In addition to the components illustrated in FIG. 2, the light 100 further includes an adjustment plate 160 and may also include a compression spring 154. The adjustment plate 160 includes index locations 162, 164, which, in cooperation with the other components and configuration of the light 100, allow the light to be adjusted relative to slot in the rail, as described below. The adjustment plate 160 also includes a protruding tab 166, which engages with a desired slot 14 on the rail 120. The tab 166 may be sized depending on the particular rail type mounted to the firearm to which the accessory is desired to be attached.

Figure 5:
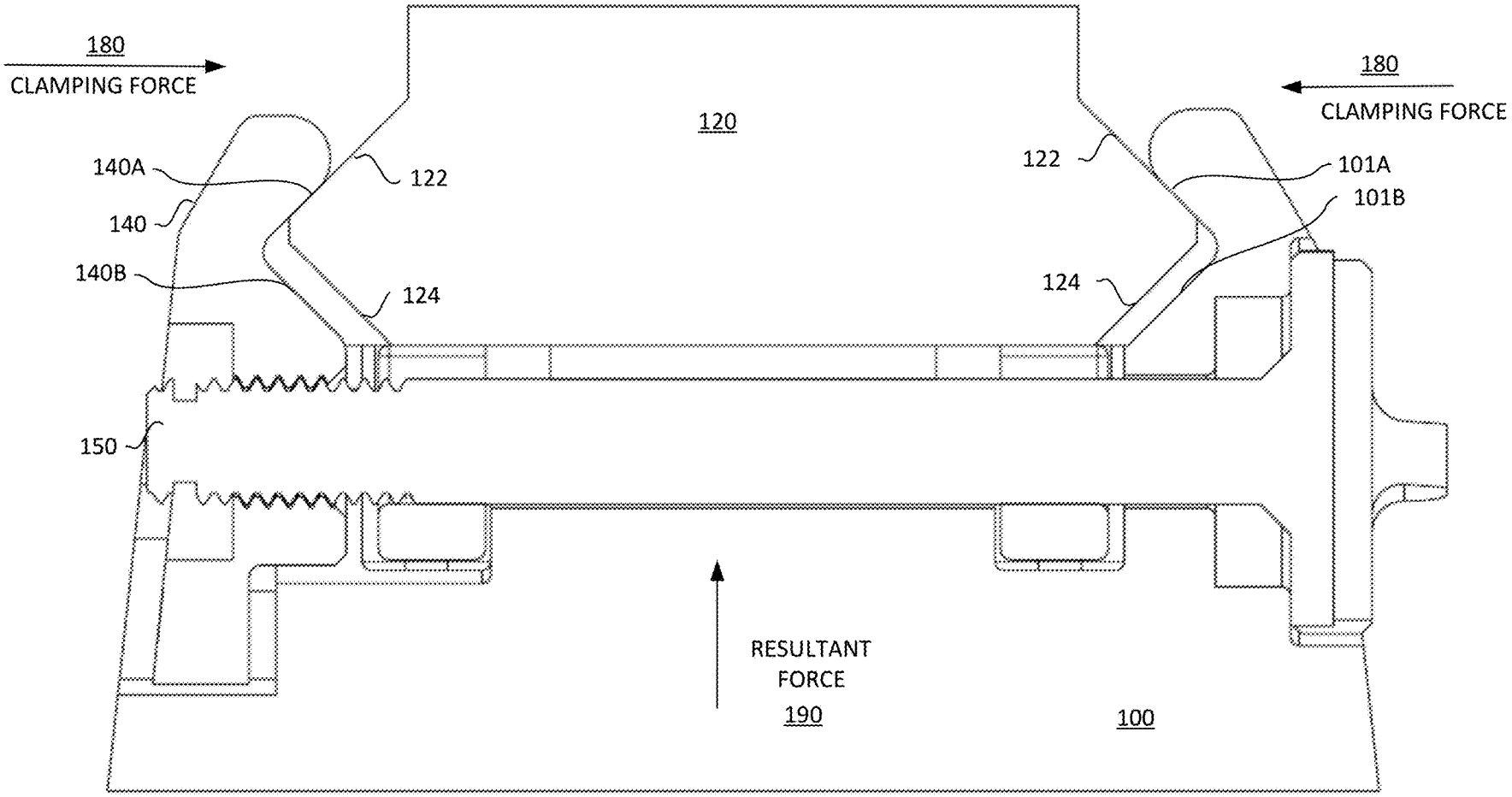
FIG. 5 is a partial cross-sectional diagram illustrating a clamping force applied to the rail and how it causes other forces applied to the accessory, according to embodiments of the invention.

FIG. 5 is a partial cross-sectional diagram illustrating forces involved by clamping an accessory to a rail to maintain the accessory in place. Note that FIG. 5 is a view from the front of the accessory, so that the keeper portion 140 appears on the left-hand side of FIG. 5.

With reference to FIGS. 3, 4, and 5, the keeper 140 is movable relative to the rail 120. In some embodiments the keeper 140 has a threaded hole 142 that engages the cross-slot bolt 150. When a user tightens the cross-slot bolt 150, the keeper 140 is drawn toward the body of the light 100 and engages the rail 120 at an upper bevel 122. This is best seen in FIG. 5. Once the cross-slot bolt 150 is fully tightened by the user, bringing the keeper 140 fully engaged against the upper bevel 122 of the rail 120, and the opposite side of the light 100 similarly engaged against the upper bevel 122 of the opposite side of the rail, the light 100 is solidly attached to the rail, and, by extension, to the firearm.

The keeper 140 includes two mating surfaces, 140A, which mates most closely to a top bevel 122 of the rail 120, as well as 140B, which mates most closely to a bottom bevel 124 of the rail. The mating surface 140B may be sized and shaped to not touch the rail 120 in some embodiments. Similarly, the main body 100 of the accessory is shaped so that a mating surface 101A mates most closely with the top bevel 122 of the rail 120, while the surface 140B mates most closely, if at all, to the bottom bevel 124 of the rail. In some embodiments, the keeper 140 could engage both bevels 122, 124 of the rail 120 with equal force. In the preferred embodiment, however, where the two mating surfaces 140A, 101A engage the upper bevel 122 of the rail 120, the overall system works to clamp the accessory 100 to the rail 120 while also creating a resultant force that helps maintain the accessory in place, and provides adjustability, as described below.

A clamping force 180 is generated when the cross-slot bolt 150 is tightened. Tightening the cross-slot bolt 150 causes the keeper 140 to be drawn toward the rail 120, where the surface 140A first engages the top bevel 122. Similarly, the surface 101A of the main body simultaneously engages the top bevel of the rail 122 at the opposite side. Further tightening of the cross-slot bolt 150, due to the shapes of the surfaces 140A, 101A and the top bevel 122 causes a resultant force 190 to be generated. This resultant force 190 presses the adjustment plate 160 and other components of the accessory 100 into the bottom of the rail 120. Further tightening of the cross-slot bolt 150 increases the holding force of the accessory 100 to the rail 120, which provides enough force so that the accessory remains in place when the firearm is fired and experiences recoil.

Figure 6A:
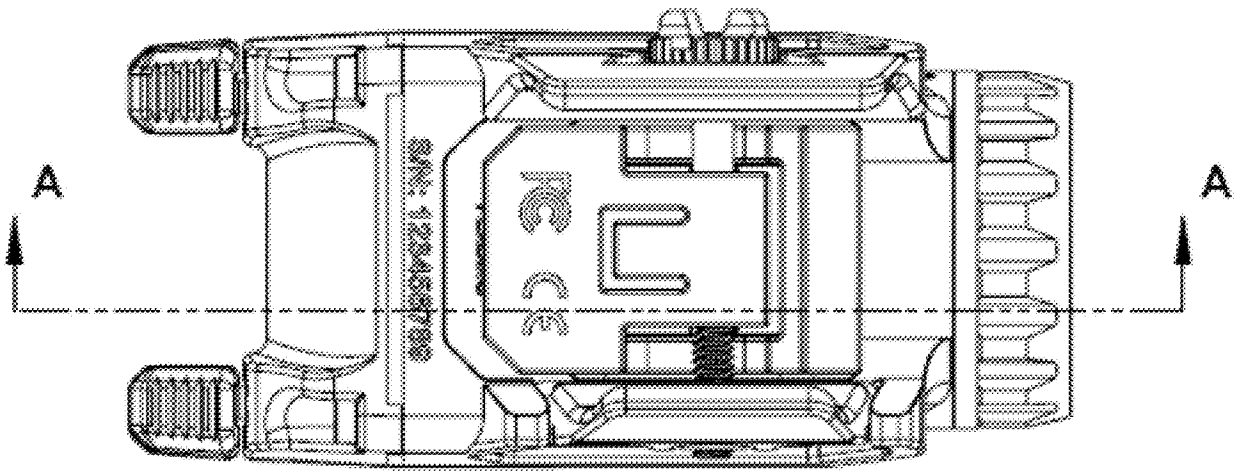
FIG. 6A is a top view of the accessory of FIG. 2.
Figure 6B:
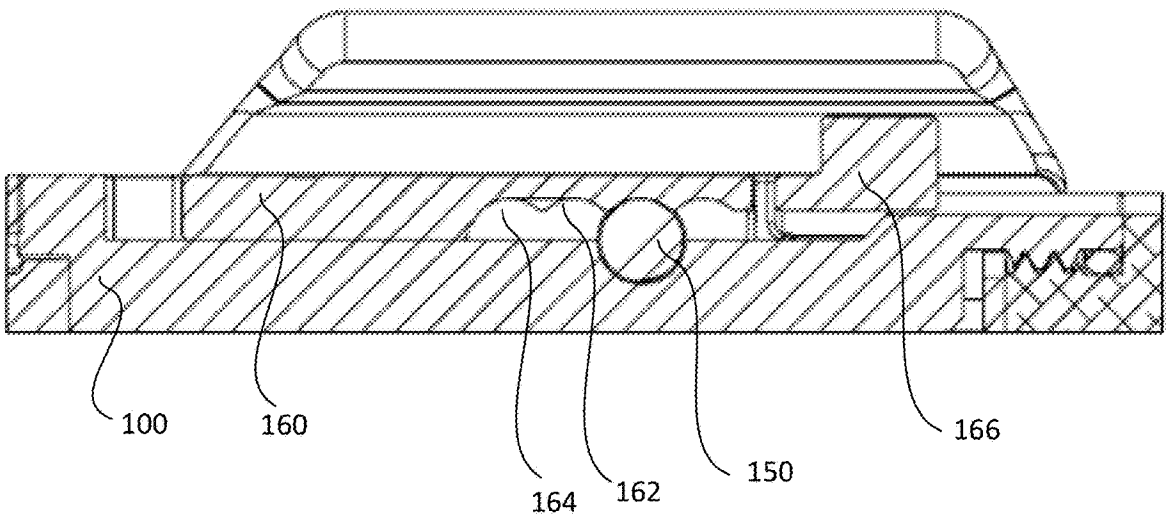
FIG. 6B is a cross-section view of the accessory illustrated in FIG. 6A along the A-A line illustrated in FIG. 6A.

FIG. 6A is a top view of the accessory 100 of FIG. 2 with the rail 120 removed. FIG. 6B is a cross-section or cut-away view of the accessory 100 illustrated in FIG. 6A along the A-A line illustrated in FIG. 6A. In FIG. 6B, the adjustment plate 160 is illustrated sitting atop a portion of the main body of the accessory 100. As described above, a portion of the adjustment plate 160 includes two or more semi-circular detents 162, 164, that ride over the cross-slot bolt 150. The detents 162, 164 provide indexing to the location of the adjustment plate 160 relative to the main body of the accessory 100 and to the slot of the rail 160 to which the tab 166 mates. In other words, if there are four detents 162, 164 in the adjustment plate 160, then the adjustment plate may be most securely located in one of the four detents. Although it is not strictly necessary for the adjustment plate 160 to include detents 162, 164, their presence provides for a secure connection between the adjustment plate 160 and the main body of the accessory 100, due to the physical interaction between the semi-circular shape of the detents 162, 164 and the round shape of the cross-slot bolt 150, while being pressed together due to the resultant force 190 (FIG. 5). Also, there can be any number of detents 162, 164 in the accessory plate, or none at all, depending on implementation details. Further, the pitch between the detents 162, 164 may be of any spacing. Generally, the spacing between the detents 162, 164 of the accessory plate have a pitch smaller than the pitch between slots 14 of the rail 120 to which the accessory 100 is mounted.

In operation, when the cross-slot bolt 150 is loosened, the resultant force 190 (FIG. 5) is released and the adjustment plate 160 is able to move longitudinally along the main axis of the accessory 100 to align the cross-slot bolt 150 to one of the four detents 162, 164 (two detents are labeled 162 and two are labeled 164, as further described below). The tab 166 of the adjustment plate 160 is inserted to the desired positioning slot 14 of the rail 120, such as illustrated in FIG. 3. If the user desires the accessory 100 to be moved forward or backward relative to the slot 14 of the rail 120, the user moves the adjustment plate 160 in the appropriate direction until the desired detent 162, 164 snaps over the cross-slot bolt 150 and into the detent. Then, the user tightens the cross-slot bolt 150 to create the resultant force 190 (FIG. 5), which holds the accessory 100 in place. After the cross-slot bolt 150 is tightened, the accessory 100 is tightly held to the rail 120, in the position of the desired detent 162, 164. To change the position of the accessory 100, the above process is repeated except the user chooses a different detent 162, 164. In some embodiments it is not necessary to completely remove the accessory 100 from the rail 20 before adjusting the adjustment plate 160.

Figure 7:
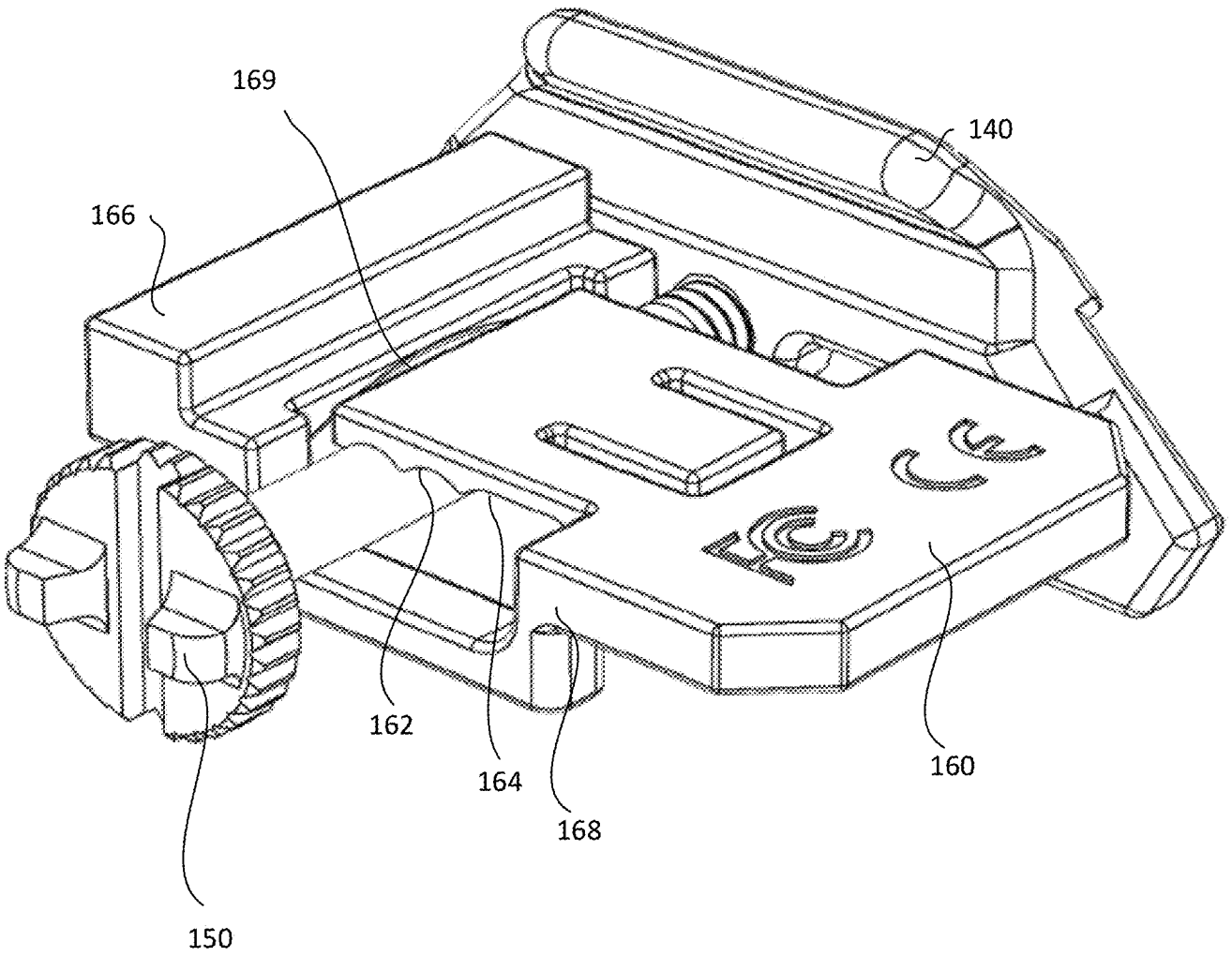
FIG. 7 is another perspective view illustrating components of the accessory.
Figure 8:
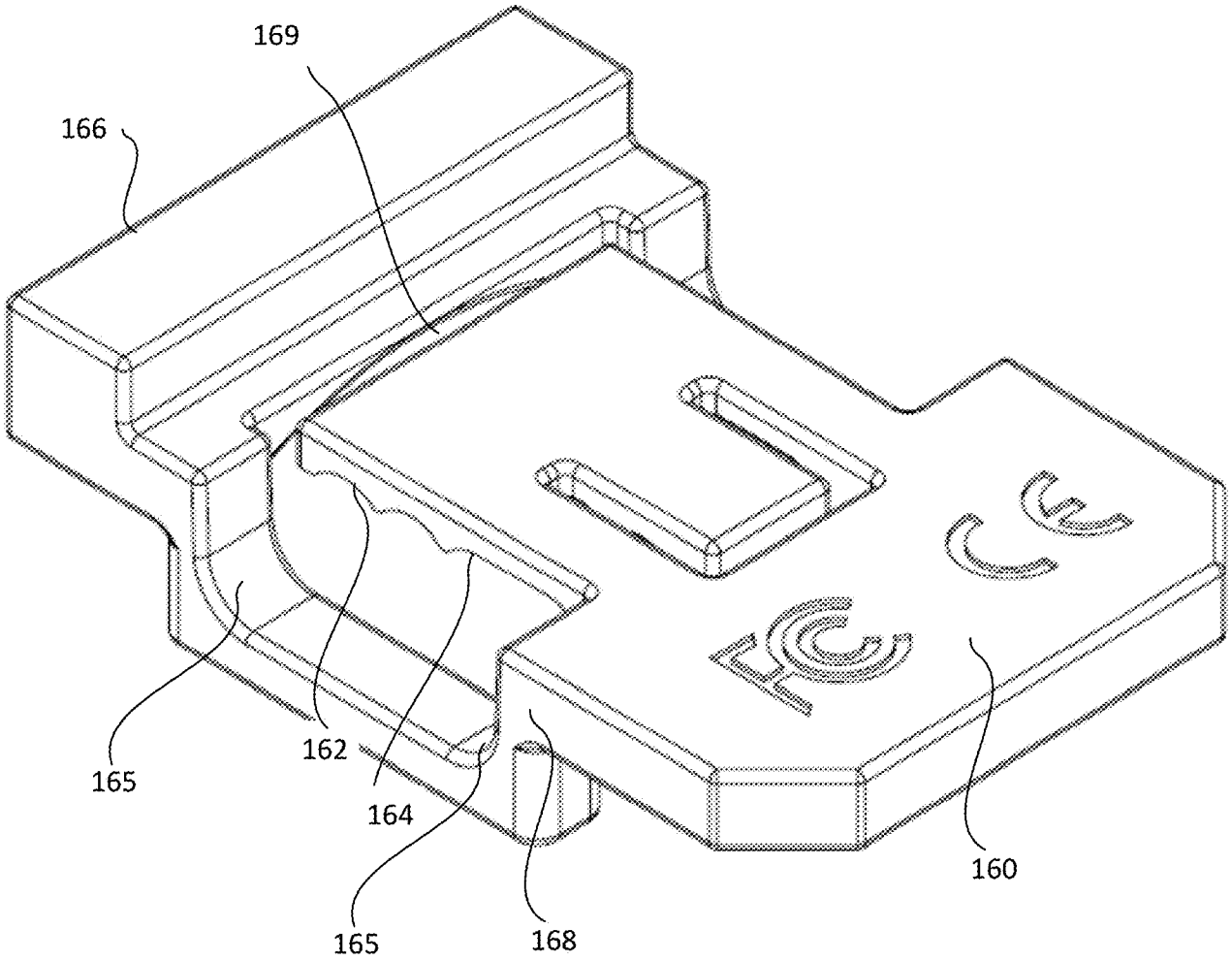
FIG. 8 is a perspective view that illustrates an adjustment plate separated from the other components of the accessory, according to embodiments of the invention.

FIG. 7 is a perspective view illustrating a cantilevered embodiment of the adjustment plate 160 along with the cross-slot bolt 150 and keeper portion 140, while FIG. 8 is a perspective view of the cantilevered embodiment of the adjustment plate 160 itself. With reference to FIGS. 7 and 8, the adjustment plate 160 includes a lever, or hinge 168, which allows the adjustment plate to have flexibility. In operation, the adjustment plate 160 operates as a cantilever. Note that a slot 169 exists in the material of the adjustment plate 160 near the tab 166. Such flexibility allows the detents 162, 164 of the adjustment plate 160 to snap over the cross-slot bolt 150 while the user is adjusting the accessory 100. FIG. 8 shows that the detents 162, 164 may have different shapes. Further, when the cross-slot bolt 150 is in the position to interact with the detent 164, a rear retainer portion 165 of the adjustment plate 160 may engage the cross-slot bolt 150 to keep the bolt in position relative to the detent 164. Thus, the front and rear retainers 165 may be shaped and positioned to help interact with the cross-slot bolt 150 to maintain the adjustment plate 160, and thus the accessory 100, in position when the cross-slot bolt is tightened. The shape of the front and rear retainers 165, as well as the overall structure of the adjustment plate 160 operates to keep the cross-slot bolt 150 retained within the accessory 100.

Figure 9:
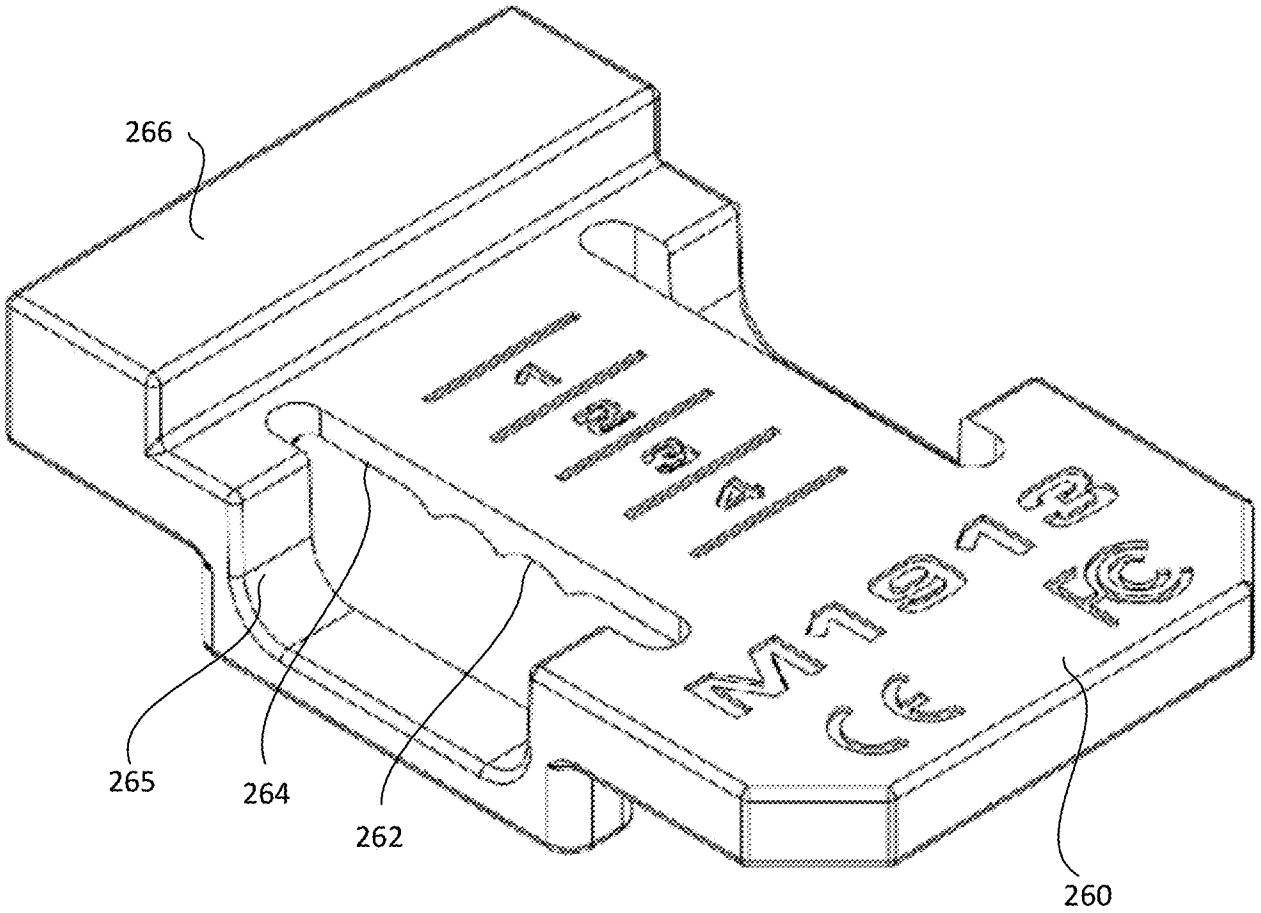
FIG. 9 is a perspective of another adjustment plate, according to embodiments of the invention.

FIG. 9 is a perspective view of an adjustment plate 260 that may be used in the place of adjustment plate 160 in the accessory 100, described above. The biggest difference between the adjustment plate 260 of FIG. 9 and the adjustment plate 160 of FIG. 8 is that the adjustment plate 260 has no gap or slot 169 between the top of the plate 260 and the tab 266. Since the adjustment plate 260 has no corresponding gap, the adjustment plate 260 is not cantilevered, and the adjustment plate 260 is therefore more rigid than the adjustment plate 160. Despite the increased rigidity of the adjustment plate 260 over the adjustment plate 160, there is still enough flexibility in the accessory, when the cross-slot bolt 150 is loosened, so that the adjustment plate 260 can snap to the desired detent 162, 164. Further, the detents 162, 164 may be labeled, such as illustrated on the top surface of the adjustment plate 260, so that the user knows which position he or she has selected. The adjustment plate 260 may differ from the adjustment plate 160 in other ways as well. For example the tab 266 may be sized or shaped differently to accommodate various slots in various rail systems.

Figure 10:
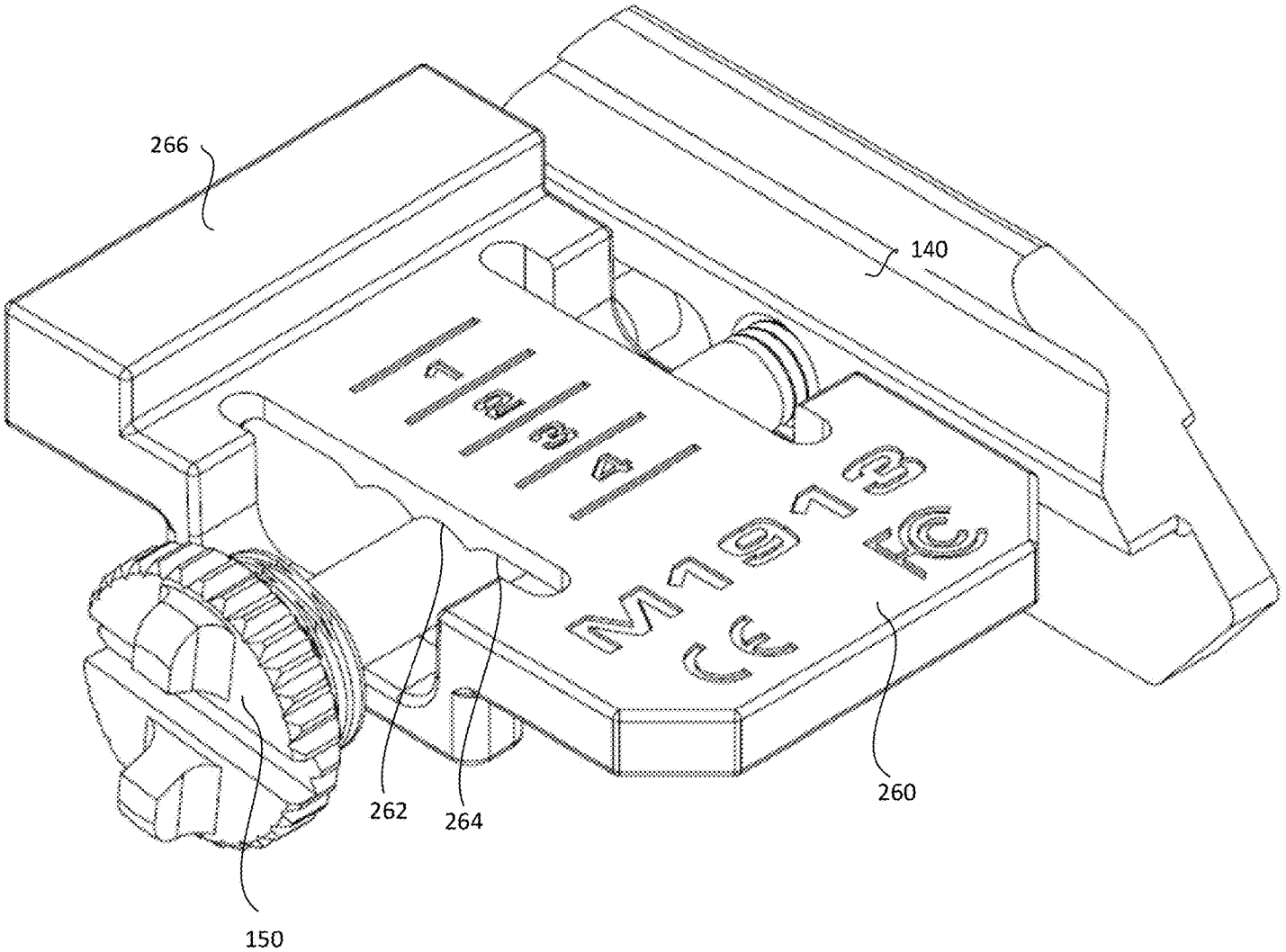
FIG. 10 is another perspective view illustrating components of the accessory in conjunction with the adjustment plate of FIG. 9.

FIG. 10 is a perspective view of a partial assembly including the adjustment plate 260, the cross-slot bolt 150, and the keeper 140.

Figure 11:
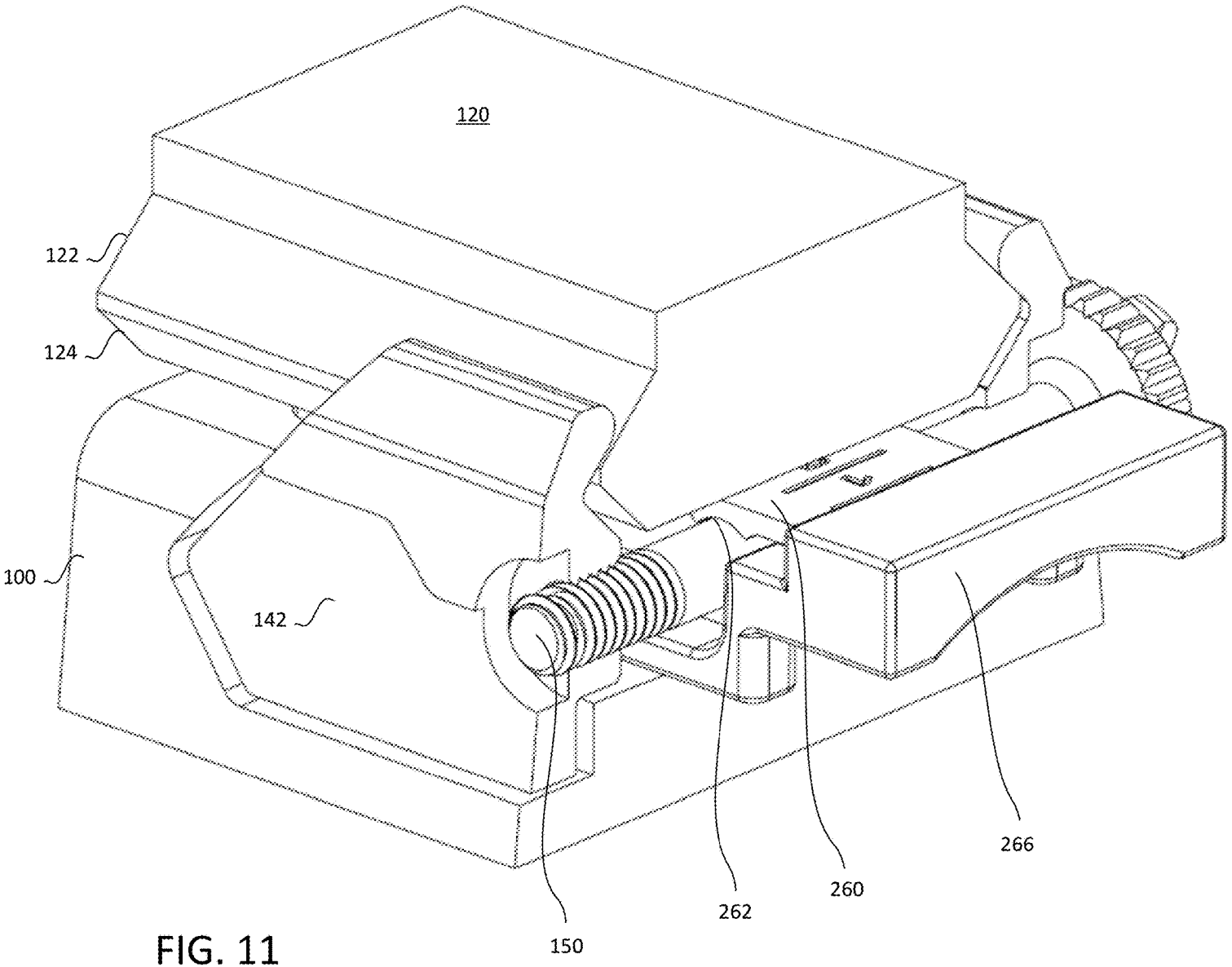
FIG. 11 is a partial cutaway view illustrating the accessory having the adjustment plate of FIG. 9 mounted on the rail, according to embodiments of the invention.

FIG. 11 is a perspective, partial cut-away view illustrating the adjustment plate 260 in an operating position relative to the accessory 100. The main body of the cross-slot bolt 150 is resting within the detent 262, which allows the accessory 100 to be securely fastened to the rail 120, as described above.

Figure 12:
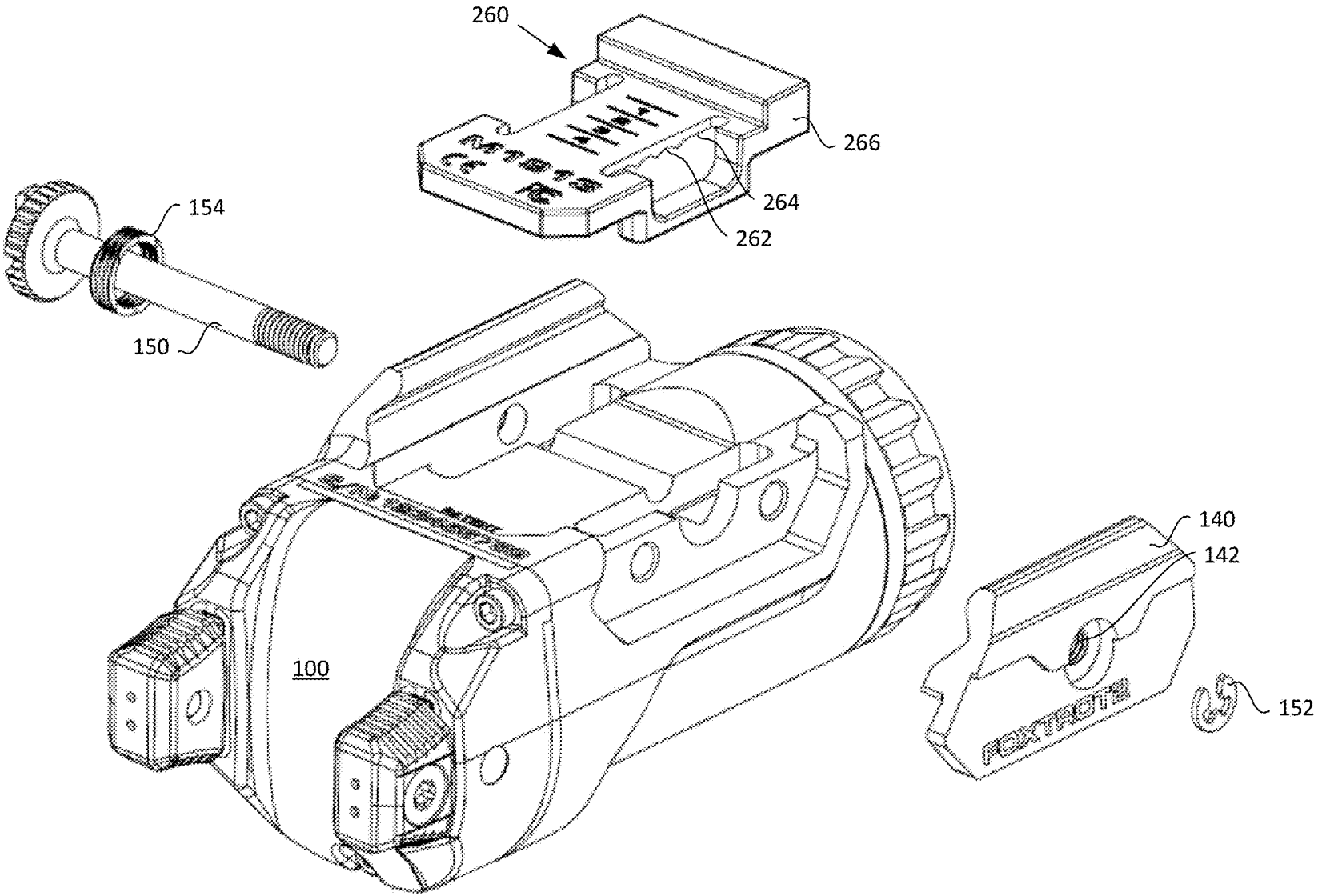
FIG. 12 is an exploded diagram similar to FIG. 4 above, illustrating the alternative adjustment plate of FIG. 9 according to embodiments of the invention.
Figure 13A:
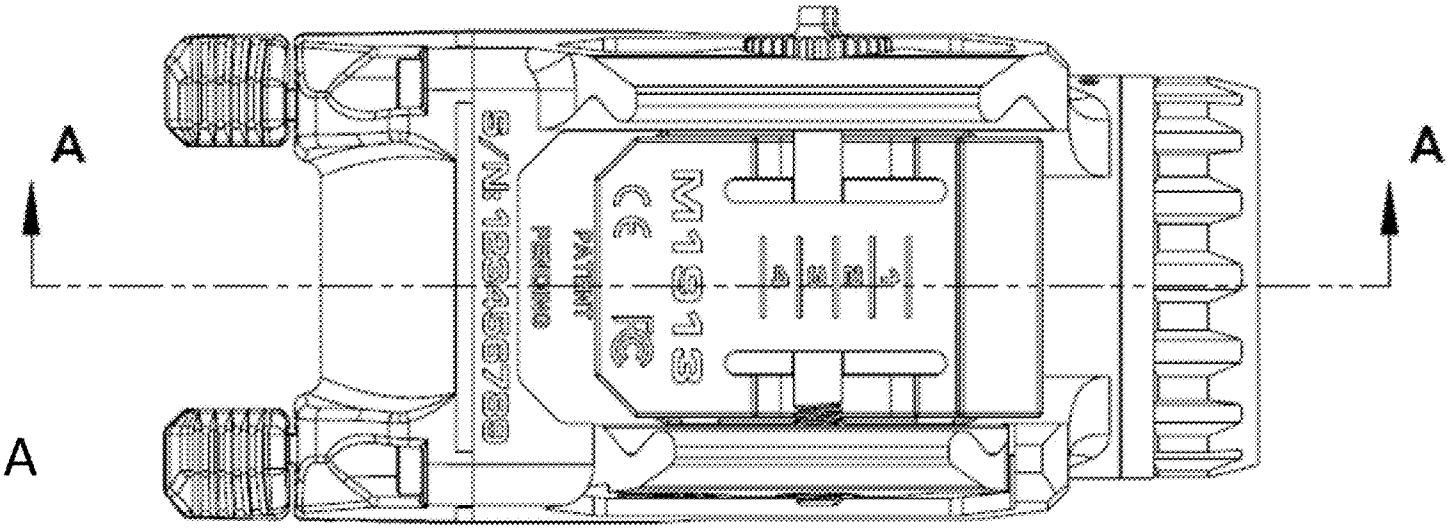
FIG. 13A is a top view of the accessory of FIG. 11, according to embodiments of the invention.
Figure 13B:
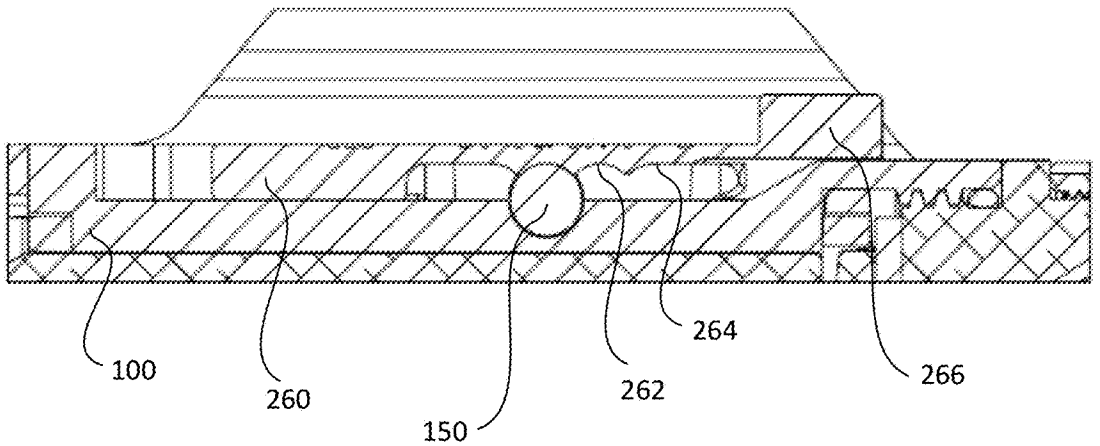
FIG. 13B is a cross-section view of the accessory illustrated in FIG. 13A along the A-A line illustrated in FIG. 13A.

FIG. 12. is an exploded perspective view of the accessory 100 including the adjustment plate 260. FIG. 13A is a top view of the accessory of FIG. 11 with the rail removed. FIG. 13B is a cross-section or cut-away view of the accessory 100 illustrated in FIG. 13A along the A-A line illustrated in FIG. 13A. The operation of the accessory 100 including the adjustment plate 260 is similar to that described above with reference to the adjustment plate 160, with the differences between the two already noted.

The aspects of the present disclosure are susceptible to various modifications and alternative forms. Specific aspects have been shown by way of example in the drawings and are described in detail herein. However, one should note that the examples disclosed herein are presented for the purposes of clarity of discussion and are not intended to limit the scope of the general concepts disclosed to the specific aspects described herein unless expressly limited. As such, the present disclosure is intended to cover all modifications, equivalents, and alternatives of the described aspects in light of the attached drawings and claims.

For example, the cross-slot bolt 150 has been described as a threaded bolt, but could be substituted with a lock-over cam or other apparatus structured to cause a clamping force between the body 100 of the accessory and the keeper 140. Further, the accessory 100 may be attached to the rail 120 in ways not illustrated above, while still allowing the accessory to be adjustable within the standard pitch of a rail slot. The cross-slot bolt may be operated manually or may be assisted with a tool, such as a screwdriver, coin, or other tool. The main body of the accessory 100 may be made from metal or other durable material. The keeper 140 may be made of the same or a different material than the main body 100. The adjustment plates 160, 260 may be formed of plastic, glassed plastic, nylon, metal, or other suitable material.

References in the specification to aspect, example, etc., indicate that the described item may include a particular feature, structure, or characteristic. However, every disclosed aspect may or may not necessarily include that particular feature, structure, or characteristic. Moreover, such phrases are not necessarily referring to the same aspect unless specifically noted. Further, when a particular feature, structure, or characteristic is described in connection with a particular aspect, such feature, structure, or characteristic can be employed in connection with another disclosed aspect whether or not such feature is explicitly described in conjunction with such other disclosed aspect.

Additionally, this written description refers to particular features. One should understand that the disclosure in this specification includes all possible combinations of those particular features. For example, where a particular feature is disclosed in the context of a particular aspect, that feature can also be used, to the extent possible, in the context of other aspects.

In addition, when this application refers to a method having two or more defined steps or operations, the defined steps or operations can be carried out in any order or simultaneously, unless the context excludes those possibilities.

Although specific embodiments have been illustrated and described for purposes of illustration, it will be understood that various modifications may be made without departing from the spirit and scope of the disclosure.

What is claimed is:

1. An accessory mounting system for adjustably mounting an accessory to a firearm accessory rail having a series of slots, the mounting system comprising:

a rail clamping system structured to clamp to the firearm accessory rail;

a mounting member including a tab structured to engage with one of the series of slots of the firearm accessory rail; and an adjustment mechanism that allows the accessory to be moved along a long axis of the firearm accessory rail less than a slot pitch of the firearm accessory rail, a portion of the adjustment mechanism being integrated with the mounting member, and the adjustment mechanism including:

an accessory plate, a cross-slot bolt, and a series of detents, in which one of the series of detents is structured to engage with the cross-slot bolt when the rail clamping system is clamped to the firearm accessory rail.

2. The accessory mounting system according to claim 1, in which a distance between adjacent detents is less than the slot pitch of the firearm accessory rail.

3. The accessory mounting system according to claim 1, in which the rail clamping system comprises at least one angled portion structured to interfere with an angled portion of the firearm accessory rail.

4. The accessory mounting system according to claim 3, in which clamping the rail clamping system to the firearm accessory rail produces a resultant force perpendicular to a clamping force of the rail clamping system.

5. An accessory mounting system for adjustably mounting an accessory to a firearm accessory rail having a series of slots, the mounting system comprising:

a rail clamping system structured to clamp to the firearm accessory rail;

a mounting member including a tab structured to engage with one of the series of slots of the firearm accessory rail; and an adjustment mechanism that allows the accessory to be moved along a long axis of the firearm accessory rail less than a slot pitch of the firearm accessory rail, a portion of the adjustment mechanism being integrated with the mounting member, and the adjustment mechanism including:

an accessory plate, and a series of detents, in which a distance between adjacent detents is less than the slot pitch of the firearm accessory rail.

6. The accessory mounting system according to claim 5, in which the adjustment member further includes a cross-slot bolt, and in which one of the series of detents is structured to engage with the cross-slot bolt when the rail clamping system is clamped to the firearm accessory rail.

7. The accessory mounting system according to claim 5, in which the rail clamping system comprises at least one angled portion structured to interfere with an angled portion of the firearm accessory rail.

8. The accessory mounting system according to claim 7, in which clamping the rail clamping system to the firearm accessory rail produces a resultant force perpendicular to a clamping force of the rail clamping system.

* * * * *